US008714915B2

(12) United States Patent
Blatchford et al.

(10) Patent No.: US 8,714,915 B2
(45) Date of Patent: May 6, 2014

(54) SOLID PARTICLE DIVERSION IN AN AXIAL FLOW STEAM TURBINE

(75) Inventors: David Paul Blatchford, Rugby (GB); Bryan Roy Palmer, Rugby (GB); Brian Robert Haller, Market Resan (GB)

(73) Assignee: Alstom Technology Ltd, Baden (CH)

( * ) Notice: Subject to any disclaimer, the term of this patent is extended or adjusted under 35 U.S.C. 154(b) by 788 days.

(21) Appl. No.: 12/952,730

(22) Filed: Nov. 23, 2010

(65) Prior Publication Data

US 2011/0123313 A1 May 26, 2011

(30) Foreign Application Priority Data

Nov. 26, 2009 (GB) ..... 0920728.3

(51) Int. Cl.
*F03B 11/08* (2006.01)

(52) U.S. Cl.
USPC ..... 415/121.2

(58) Field of Classification Search
USPC ..... 415/121.2, 169.1, 169.2, 169.3, 169.4
See application file for complete search history.

(56) References Cited

U.S. PATENT DOCUMENTS

| | | | | |
|---|---|---|---|---|
| 3,066,912 A | * | 12/1962 | Scheper, Jr. | 415/121.2 |
| 4,726,813 A | | 2/1988 | Viscovich | |
| 4,776,765 A | | 10/1988 | Sumner et al. | |
| 5,271,712 A | * | 12/1993 | Brandon | 415/121.2 |
| 7,296,964 B2 | | 11/2007 | Montgomery | |
| 2007/0071594 A1 | | 3/2007 | Montgomery | |

FOREIGN PATENT DOCUMENTS

| | | | |
|---|---|---|---|
| GB | 314 496 | A | 5/1930 |
| GB | 332871 | A | 7/1930 |
| JP | 2002-250205 | A | 9/2002 |
| JP | 2009-138540 | A | 6/2009 |
| SU | 920236 | A | 4/1982 |

OTHER PUBLICATIONS

United Kingdom Search Report for GB 0920728.3 dated Mar. 8, 2010.

Search Report dated Mar. 2, 2012, issued in corresponding German Patent Application No. 10 2010 051 063.7. (5 pages).

* cited by examiner

*Primary Examiner* — Nathaniel Wiehe
*Assistant Examiner* — Jeffrey A Brownson
(74) *Attorney, Agent, or Firm* — Buchanan Ingersoll & Rooney PC

(57) ABSTRACT

An exemplary axial flow steam turbine is disclosed which includes a motor, a turbine casing and at least first and second turbine stages, with the second turbine stage being located adjacent to and downstream from the first turbine stage. A radially outer static diaphragm ring of the second turbine stage includes an annular axial extension extending in an upstream axial direction and carrying a circumferential tip sealing device which cooperates with shrouds of a circumferential row of moving blades of the first turbine stage. An upstream end of the annular axial extension is axially spaced from a radially outer static diaphragm ring of the first turbine stage such that a circumferential passage is defined between the upstream end of the annular axial extension and the radially outer static diaphragm ring of the first turbine stage. Solid particles are diverted from steam flow by a circumferential passage during operation.

11 Claims, 3 Drawing Sheets

SOLID PARTICLE DIVERSION IN AN AXIAL FLOW STEAM TURBINE

RELATED APPLICATIONS

This application claims priority under 35 U.S.C. §119 to United Kingdom Patent Application No. 0920728.3 filed in United Kingdom on Nov. 26, 2009, the entire content of which is hereby incorporated by reference in its entirety.

FIELD

The present disclosure relates to axial flow steam turbines and, for example, to reducing susceptibility to damage as a result of solid particle erosion (SPE) in axial flow steam turbines. To reduce susceptibility of the steam turbine to solid particle erosion, exemplary embodiments of the present disclosure relate to extraction of solid particles from the steam flow as it is expanded through the turbine.

BACKGROUND INFORMATION

Steam turbines, for example, intermediate pressure steam turbines, can be susceptible to solid particle erosion (SPE). Solid particle erosion occurs when solid particles within the steam flowing through the turbine impact the rotating and stationary turbine component parts. The solid particles within the steam can cause erosion of the static blades (or nozzles), rotating blades (or buckets) and tip sealing devices that are in sealing relationship with the shrouds at the tips of the rotating blades. Although solid particle erosion can occur at any point along the steam flow path through a steam turbine, it can be prevalent in the early turbine stages of an intermediate pressure (IP) steam turbine.

Erosion of the trailing edge region of the static blades of a turbine stage can be a particular concern and is known to be caused by rebound of the solid particles off the rotating blades of that particular turbine stage, in a direction opposite to the steam flow direction through the turbine. Known responses for reducing this particular type of solid particle erosion are described in U.S. Pat. No. 4,776,765. One response is to provide a coating or sheet of protective material on the trailing edge of the static blades of a turbine stage to minimise the susceptibility of those blades to solid particle erosion due to rebound off the adjacent rotating blades of the turbine stage. Another response, which can be used alone or in combination with the aforesaid protective material, is to increase the spacing between the static blades and the rotating blades of a turbine stage to thereby reduce the momentum of any rebounding solid particles.

The responses proposed in U.S. Pat. No. 4,776,765 seek to address erosion to the trailing edge of the rotating blades of a turbine stage whereas, as mentioned above, solid particle erosion can occur at any point along the steam flow path through the turbine. While it may be desirable to reduce solid particle erosion at any point in the steam flow path through a steam turbine by eliminating the solid particles from the steam flow before the steam reaches the turbine, this is impractical. Other responses have, therefore, been proposed.

One response, described in U.S. Pat. No. 4,726,813, utilizes electromagnets, arranged on the piping connecting the boiler to the turbine, to create a magnetic field and thereby deflect solid metallic particles within the steam flow to a desired location where they are collected. The steam then proceeds to the steam turbine for expansion through the turbine stages.

Another response, described in U.S. Pat. No. 7,296,964, is to divert a proportion of the solid-particle-containing steam flowing through the steam turbine away from the main steam flow path, to the feed water heater of the turbine. The diverted steam thereby bypasses downstream rotating components. Holes and passages can generally be provided in the component parts of the steam turbine to permit the diversion of a proportion of the solid-particle-containing steam and in one embodiment, holes and passages can be provided in the radially outer static ring of the first turbine stage. These holes and passages communicate with a passage in the radially outer static ring of the second, downstream, turbine stage to divert a proportion of the steam away from the rotating blades and blade tip sealing devices of the first turbine stage into a steam extraction passage to the feed water heater.

The responses described in both U.S. Pat. No. 4,726,813 and U.S. Pat. No. 7,296,964 are complex and may not always provide a sufficient reduction in the level of solid particles contained within the steam flow. The complexity of the response proposed in U.S. Pat. No. 7,296,964 arises partly from the fact that holes and passages need to be formed through the radially outer static rings and tip sealing devices of multiple stages of the steam turbine. Furthermore, because the holes and passages are provided in the radially outer static ring at only predetermined circumferential positions, the ability to divert solid particle containing steam can be limited, thus limiting the effectiveness of the proposed solution.

Exemplary embodiments disclosed herein are directed to improved extraction of solid particles from axial flow steam turbines to render them less susceptible to damage arising from solid particle erosion (SPE).

SUMMARY

An axial flow steam turbine is disclosed which includes a turbine casing containing a turbine stage. The turbine stage includes a row of static blades; a row of moving blades located downstream of the static blades in a turbine passage, the moving blades having radially outer shrouds that sealingly co-operate with an outer wall portion of the turbine passage; and a circumferentially and radially extending passage provided in the outer wall portion upstream of the row of moving blades, to divert solid particles from steam flow during operation of the steam turbine, wherein the turbine casing between adjacent turbine stages includes a circumferential collection channel for collecting solid particles diverted through the circumferentially and radially extending passage, wherein the circumferential collection channel includes plural circumferentially spaced flow arresters arranged to minimise circumferential flow of solid particles within the circumferential collection channel, and wherein each of the circumferentially spaced flow arresters extends axially across the circumferential collection channel to divide the circumferential collection channel into a of plural circumferential compartments.

An axial flow steam turbine is also disclosed which includes a rotor, a turbine casing, and plural of turbine stages, each turbine stage comprising a radially outer static diaphragm ring mounted inside the turbine casing, a radially inner static diaphragm ring, a circumferential row of static blades extending between the radially outer and radially inner static diaphragm rings, a circumferential row of moving blades positioned adjacent to and downstream from the circumferential row of static blades, each of the moving blades including a root portion held by the rotor and a tip portion including a shroud, wherein at least one turbine stage subsequent to a first stage of the turbine has an annular axial extension of its radially outer static diaphragm ring, which extension extends in an upstream axial direction towards the radially outer static diaphragm ring of a preceding adjacent turbine stage to form an outer wall portion of a turbine passage in the preceding turbine stage, the annular axial extension carrying a circumferential sealing device which cooperates with the shrouds of the circumferential row of moving blades of the preceding turbine stage, an upstream end of the annular axial extension being axially spaced from the radially outer static diaphragm ring of the preceding turbine stage to define a circumferential passage therebetween in the preceding turbine stage, such that during operation of the steam turbine solid particles will be diverted from steam flow through the turbine passage upstream of the circumferential row of moving blades of said preceding turbine stage.

DETAILED DESCRIPTION

Figure 1:
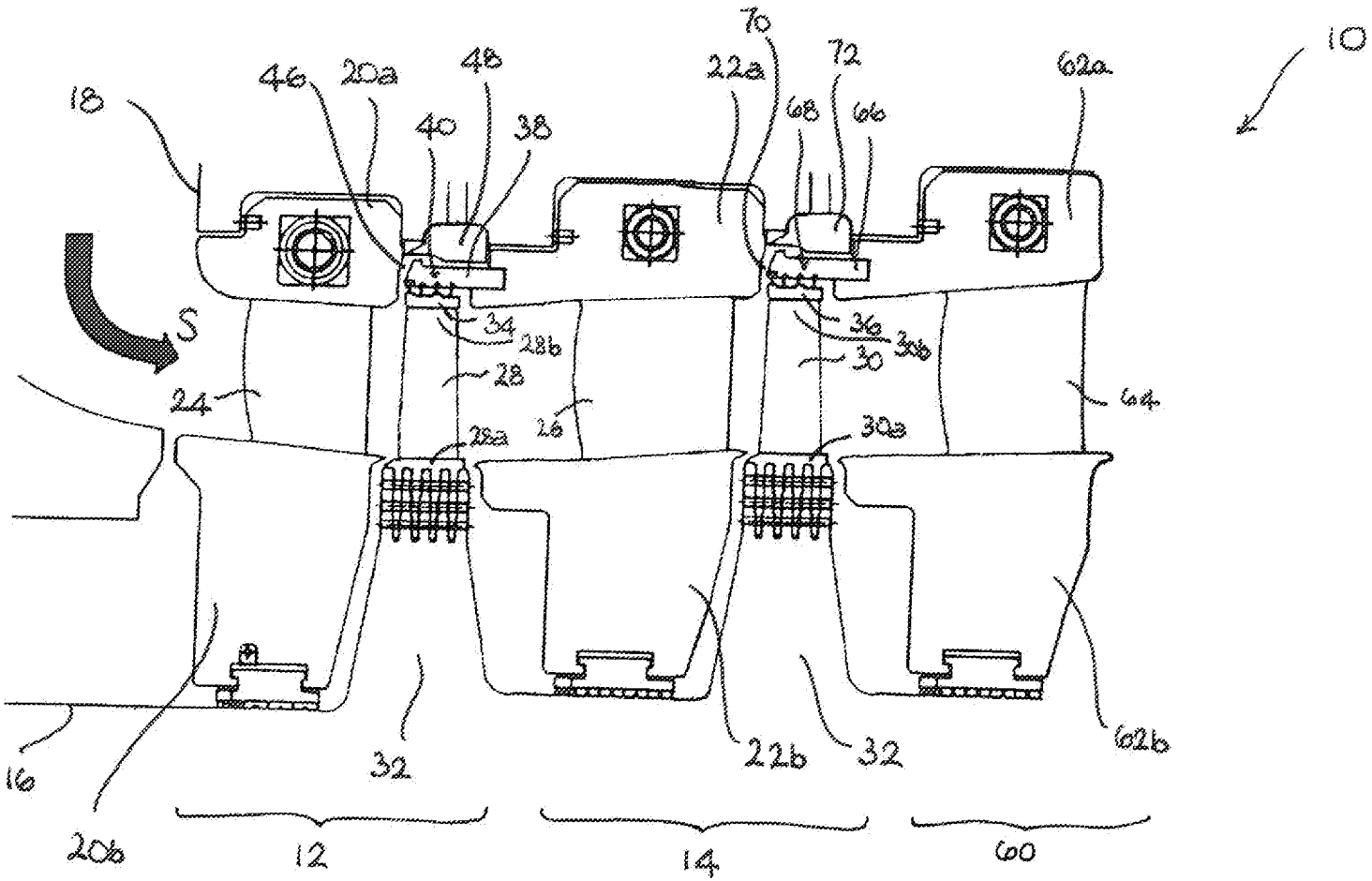
FIG. 1 is a diagrammatic cross-sectional view of part of an axial flow steam turbine according to one exemplary embodiment of the present disclosure.

An exemplary embodiment of the disclosure provides an axial flow steam turbine having a turbine casing containing a turbine stage including a row of static blades and a row of moving blades downstream of the static blades. The moving blades having radially outer shrouds that sealingly co-operate with an outer wall portion of the turbine passage. A circumferentially extending passage can be provided in the outer wall portion upstream of the row of moving blades, thereby to divert solid particles from the steam flow during operation of the steam turbine.

In an exemplary embodiment, an axial flow steam turbine is provided, including a rotor, a turbine casing and a plurality of turbine stages. Each turbine stage can include a radially outer static diaphragm ring mounted inside the turbine casing, a radially inner static diaphragm ring, and a circumferential row of static blades extending between the radially outer and radially inner static diaphragm rings. A circumferential row of moving blades can be positioned adjacent to and downstream from the circumferential row of static blades. Each of the moving blades can include a root portion held by the rotor and a tip portion including a shroud. At least one turbine stage subsequent to the first stage of the turbine can have an annular axial extension of its radially outer static diaphragm ring, which extension extends in the upstream axial direction towards the radially outer static diaphragm ring of a preceding adjacent turbine stage to form an outer wall portion of the turbine passage in the preceding turbine stage. The annular axial extension can carry a circumferential sealing device which cooperates with the shrouds of the circumferential row of moving blades of the preceding turbine stage. An upstream end of the annular axial extension can be axially spaced from the radially outer static diaphragm ring of the preceding turbine stage such that a circumferential passage can be defined therebetween in the preceding turbine stage. During operation of the steam turbine solid particles can be diverted from the steam flow through the turbine passage upstream of the circumferential row of moving blades of the preceding turbine stage.

The provision of a circumferential passage upstream of the circumferential row of moving blades of the "preceding" turbine stage (for example, the first stage of the turbine) can enable solid particles to be extracted from the steam before they are directed by the circumferential row of static blades onto the adjacent immediately downstream circumferential row of moving blades. Rebound of the solid particles from the moving blades onto the trailing edges of the static blades of the first turbine stage can thus be advantageously minimised.

By making the circumferential passage continuous in the circumferential direction, it is possible to extract a larger proportion of solid particles from the steam flowing through the first turbine stage than is possible in, for example, U.S. Pat. No. 7,296,964. Solid particle erosion damage can thus be significantly reduced.

Whatever the exact structural features of the turbine, it is envisaged that the circumferentially extending passage can be provided in at least the first stage of the turbine. It may be desirable to provide such a passage in the second stage, and perhaps also in one or more subsequent stages. In an exemplary embodiment of the turbine structure, the passage in the first stage can be formed between a radially outer static diaphragm ring of the first stage of the turbine and an annular axial extension of a radially outer static diaphragm ring of the second stage of the turbine. Similarly, a passage in the second stage can be formed between a radially outer static diaphragm ring of the second stage of the turbine and an annular axial extension of a radially outer static diaphragm ring of the third stage of the turbine, and so on.

Such an arrangement can provide the advantage that solid particles which have not been diverted through the circumferential passage between the circumferential rows of static and moving blades of the first turbine stage and which are still contained within the steam flowing through the second turbine stage, can be diverted through the circumferential passage defined between the circumferential rows of static and moving blades of the second turbine stage upstream of the circumferential row of moving blades of the second turbine stage, and so on. Solid particle erosion can thus be further reduced.

In some exemplary embodiments, the annular axial extension can be integral with the radially outer static diaphragm ring of the second turbine stage (for example, it is manufactured as part of the radially outer static diaphragm ring of the second turbine stage). In other exemplary embodiments, the annular axial extension can include a ring that is secured, for example, by mechanical fasteners, to the radially outer static diaphragm ring of the second turbine stage.

The turbine casing between the adjacent turbine stages can include a circumferential collection channel for collecting solid particles diverted through the circumferential passage. The circumferential collection channel can function to collect solid particles that have been diverted through the circumferential passage from the steam flow upstream of the circumferential row of moving blades of the turbine stage. Solid particles diverted through the circumferential passage pass into the circumferential channel, and can be evacuated therefrom, thereby minimising the likelihood of re-entry of the solid particles into the steam flow through the circumferential passage. The circumferential collection channel can also ensure that the collected solid particles are removed from the vicinity of the circumferential sealing device, thus reducing the risk of erosion of the tip sealing device.

The circumferential passage can communicate in a generally radial direction with an inlet region of the circumferential collection channel.

The circumferential passage may have an inclined surface operative to direct solid particles from the circumferential passage into the circumferential collection channel. In an exemplary embodiment of a turbine structure, the inclined surface can conveniently be provided by an upstream end of the annular axial extension. This inclined surface can slope away from the radially outer static diaphragm ring of the first turbine stage in a radially outward direction, towards the circumferential collection channel. Furthermore, the upstream end of the annular axial extension can include a radially outwardly extending shoulder to hinder re-entry of collected solid particles from the circumferential collection channel into the circumferential passage and hence into the steam flowing through the turbine.

For each turbine stage to which the disclosure is applied, the circumferential passage can be substantially aligned with leading edges of the moving blades. Hence, the upstream end of the annular axial extension and the leading edges of the moving blades and shrouds of the turbine stage can be generally radially aligned with each other to maximise the number of solid particles diverted into the circumferential passage by the tangential motion of the steam flow.

The circumferential collection channel in the turbine casing may include a liner to minimise or prevent erosion of the turbine casing by solid particles diverted through the circumferential passage into the circumferential collection channel. The provision of a liner in the circumferential channel can be useful because solid particles collected in the circumferential collection channel will tend to cause erosion of the liner rather than the turbine casing. Repair or replacement of the liner can be more straightforward than repair or replacement of the turbine casing. The liner can include a plurality of part-annular liner segments which, when mounted inside the circumferential collection channel, cooperate to form a circumferential liner.

The circumferential collection channel can include a plurality of circumferentially spaced flow arresters arranged to inhibit the circumferential migration of solid particles within the circumferential collection channel. This can assist with maintaining collected solid particles inside the circumferential collection channel. Each of the circumferentially spaced flow arresters can extend axially across the circumferential collection channel and the circumferential collection channel can thus be divided into a plurality of circumferential collection compartments. The flow arresters can be formed integrally with the liner.

In some exemplary embodiments, the circumferential collection channel can be dimensioned such that it has adequate capacity to accumulate collected solid particles over a predetermined period of time.

In other exemplary embodiments, the steam turbine can include a particle extraction arrangement (for example, a suction pipe) having at least one inlet that communicates with the circumferential collection channel for extracting solid particles from the circumferential collection channel.

For exemplary embodiments in which the circumferential collection channel is continuous, or in which the flow arresters (if provided) are not arranged to completely inhibit circumferential migration of the particles, the at least one inlet of the particle extraction arrangement can communicate with a lower circumferential region of the circumferential collection channel. Such an arrangement can be useful because solid particles collected in the upper circumferential region of the circumferential collection channel will tend to migrate to the lower circumferential region of the circumferential collection channel under the action of gravity and other forces.

For exemplary embodiments in which the circumferential collection channel is divided into a plurality of compartments, each compartment can be provided with at least one inlet of the particle extraction arrangement.

An exemplary embodiment of the steam turbine can include a fluid inlet arrangement for injecting fluid, such as air, into the circumferential collection channel. The introduction of fluid can be useful as it may dislodge solid particles that have accumulated within the circumferential collection channel and enable the accumulated solid particles to be more readily extracted by the particle extraction arrangement Exemplary embodiments of the disclosure will now be described with reference to the accompanying drawings.

FIG. 1 illustrates part of one exemplary embodiment of an axial flow steam turbine 10 with the direction of steam flow through the turbine 10 being indicated by the arrow S. The steam turbine 10 includes a plurality of turbine stages through which steam is expanded during operation of the turbine 10. Two complete turbine stages, namely first and second turbine stages 12, 14, are illustrated in FIG. 1, but only part of a third turbine stage 60 is shown. It will be readily appreciated that the second turbine stage 14 is located immediately adjacent to and downstream from the first turbine stage 12 and that the third turbine stage 60 is located adjacent to and immediately downstream from the second turbine stage 14.

The steam turbine 10 includes a rotor 16, only part of which is shown, and a turbine casing 18. Each of the first, second and third turbine stages 12, 14, 60 includes a radially outer static diaphragm ring 20*a*, 22*a*, 62*a* which is mounted inside the turbine casing 18, and a corresponding radially inner static diaphragm ring 20*b*, 22*b*, 62*b*. Rows of circumferentially extending static blades 24, 26, 64 (also known as stator vanes or nozzle partitions) extend between the radially outer static diaphragm rings 20*a*, 22*a*, 62*a* and the radially inner static diaphragm rings 20*b*, 22*b*, 62*b* of the first, second and third turbine stages 12, 14, 60 respectively.

Each turbine stage 12, 14 include a circumferential row of moving blades 28, 30, located adjacent to and immediately downstream from its associated circumferential row of static blades 24, 26. Each of the moving blades 28, 30 includes a root portion 28*a*, 30*a* which is secured to discs 32 formed on the rotor 16 by pins or other suitable means. Each of the moving blades 28, 30 also includes a tip portion 28*b*, 30*b* carrying a shroud 34, 36, and the shrouds of the individual moving blades 28, 30 cooperate to form a continuous shroud ring.

The radially outer static diaphragm ring 22*a* of each stage subsequent to the first stage, in particular the second turbine stage 14, includes an annular axial extension 38 which extends in the axially upstream direction, towards the radially outer static diaphragm ring 20*a* of the preceding or first turbine stage 12, thereby forming an outer wall of the turbine passage. In the illustrated exemplary embodiment, the annular axial extension 38 includes an extension ring which is secured mechanically or by welding to the radially outer static diaphragm ring 22*a* of the second turbine stage 14.

Figure 2:
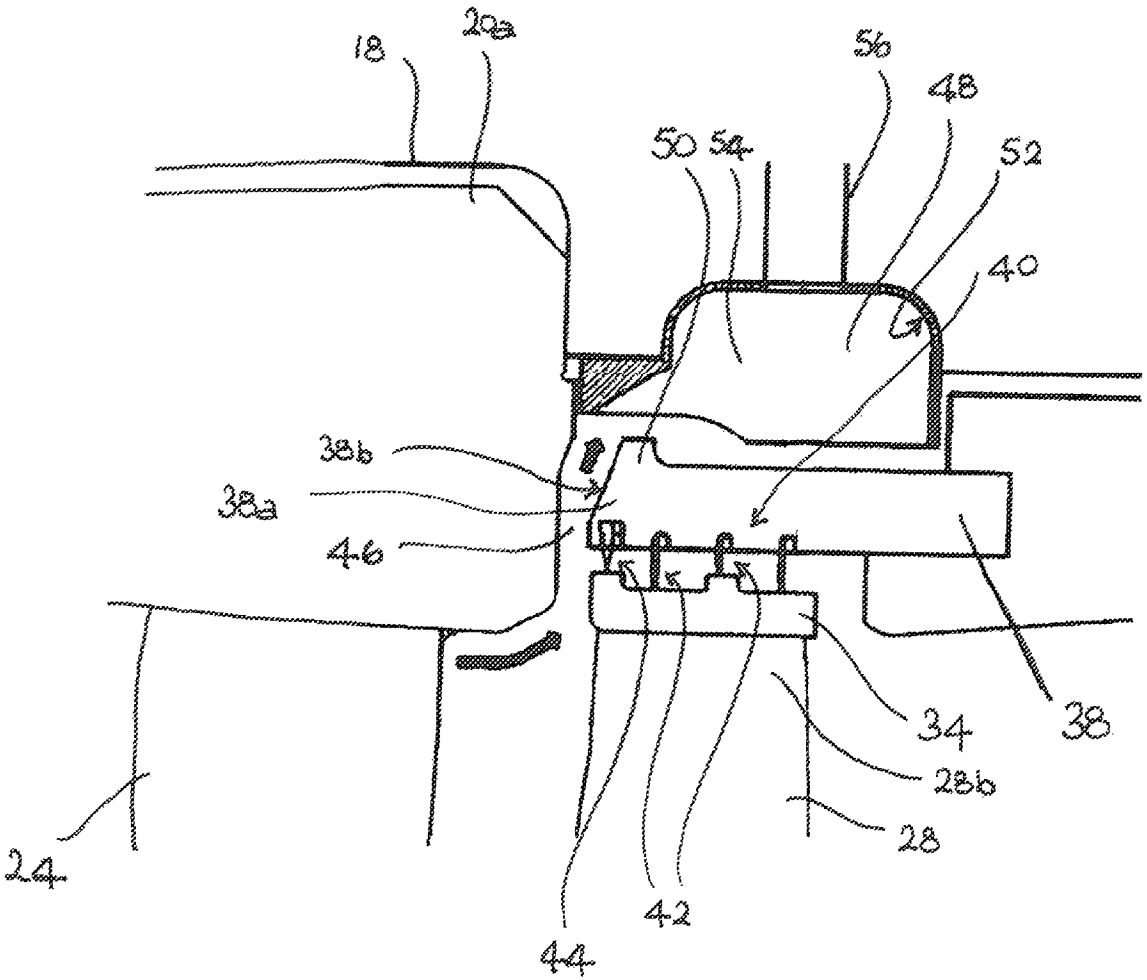
FIG. 2 is an enlarged diagrammatic cross-sectional view of part of the axial flow steam turbine illustrated in FIG. 1.

As can be seen more clearly in FIG. 2, the radially outer shrouds 34 of the first stage moving blades sealingly cooperate with the outer wall of the turbine passage, as defined by the annular axial extension 38, because extension 38 carries a circumferential sealing device 40 which cooperates with the moving blade shrouds 34 of the first turbine stage 12 to minimise the leakage of steam between the shrouds and the annular axial extension 38. The sealing device 40 can take any suitable form, but in the illustrated exemplary embodiment includes a fin-type labyrinth seal including a plurality of axially spaced and circumferentially extending sealing strips 42 having hooked ends caulked into the annular axial extension 38. A circumferentially extending triangular sealing fin 44, again caulked into the annular axial extension 38, can also be provided.

To divert solid particles from the steam flow during operation of the steam turbine, a circumferentially and radially extending passage 46 is provided in the outer wall of the turbine passage, the passage being substantially (i.e., generally) radially aligned with leading edges of the moving blades 28 and their shrouds 34.

In more detail, the annular axial extension 38 includes an axially upstream end 38*a* which is axially spaced from the radially outer static diaphragm ring 20*a* of the first turbine stage 12. The circumferential passage 46 can thus be defined between the upstream end 38*a* of the annular axial extension 38 and the radially outer static diaphragm ring 20*a*. During operation of the steam turbine 10, solid particles contained within the steam flowing through the first turbine stage 12 can be directed into the circumferential passage 46, upstream of the circumferential row of moving blades 28 of the first turbine stage 12, by virtue of the tangential motion of the steam flow and those solid particles can then diverted away from the steam flow by the generally radial orientation of circumferential passage 46. Erosion of the circumferential rows of static and moving blades 24, 28 of the first turbine stage 12 can thus be desirably reduced due to the reduction of solid particles within the steam flowing through the first turbine stage 12.

In order to reduce the likelihood of any diverted solid particles re-entering into the steam flowing through the steam turbine 10, the turbine casing 18 can include a circumferential collection channel 48 in which solid particles diverted by the circumferential passage 46 from the steam flowing through the first turbine stage 12 can be collected and accumulated. The circumferential collection channel 48 can be located in the turbine casing 18 between the radially outer static diaphragm rings 20*a*, 22*a* of the adjacent first and second turbine stages 12, 14.

To assist diversion of the solid particles from the circumferential passage 46 into the circumferential collection channel 48; the upstream end 38*a* of the annular axial extension 38 includes an inclined annular surface 38*b*. The inclined annular surface 38*b* slopes away from the radially outer static diaphragm ring 20*a* of the first turbine stage 12 in a substantially (i.e., generally) radially outward direction, towards the circumferential collection channel 48.

During operation of the turbine, particles swept into the circumferential collection channel 48 will tend to circulate around it, impelled by the flow entering through the circumferential passage 46. To minimise re-entry of solid particles from the circumferential collection channel 48 into the circumferential passage 46, and hence into the steam flowing through the first turbine stage 12, the annular axial extension 38 has a circumferentially extending, radially outwardly projecting shoulder 50 at its upstream end 38*a*.

In one exemplary embodiment, the circumferential collection channel 48 can be formed directly in the turbine casing 18. However, in this arrangement, the turbine casing 18 may be subject to erosion by the solid particles diverted into the circumferential collection channel 48. In other exemplary embodiments, the circumferential collection channel 48 can, therefore, include a liner 52 formed, for example, by a plurality of cooperating part-circumferential liner segments. The liner 52 can be formed from the same material as the turbine casing 18, in which case it acts as a sacrificial material which will be subject to erosion by the solid particles, or can alternatively be formed from a material which is harder than the turbine casing 18 and, therefore, less susceptible to erosion by the collected solid particles. In either case, the liner 52 could simply be replaced as desired during overhaul of the steam turbine 10 or at another suitable time in the event of an unacceptable level of erosion by the collected solid particles.

Figure 3:
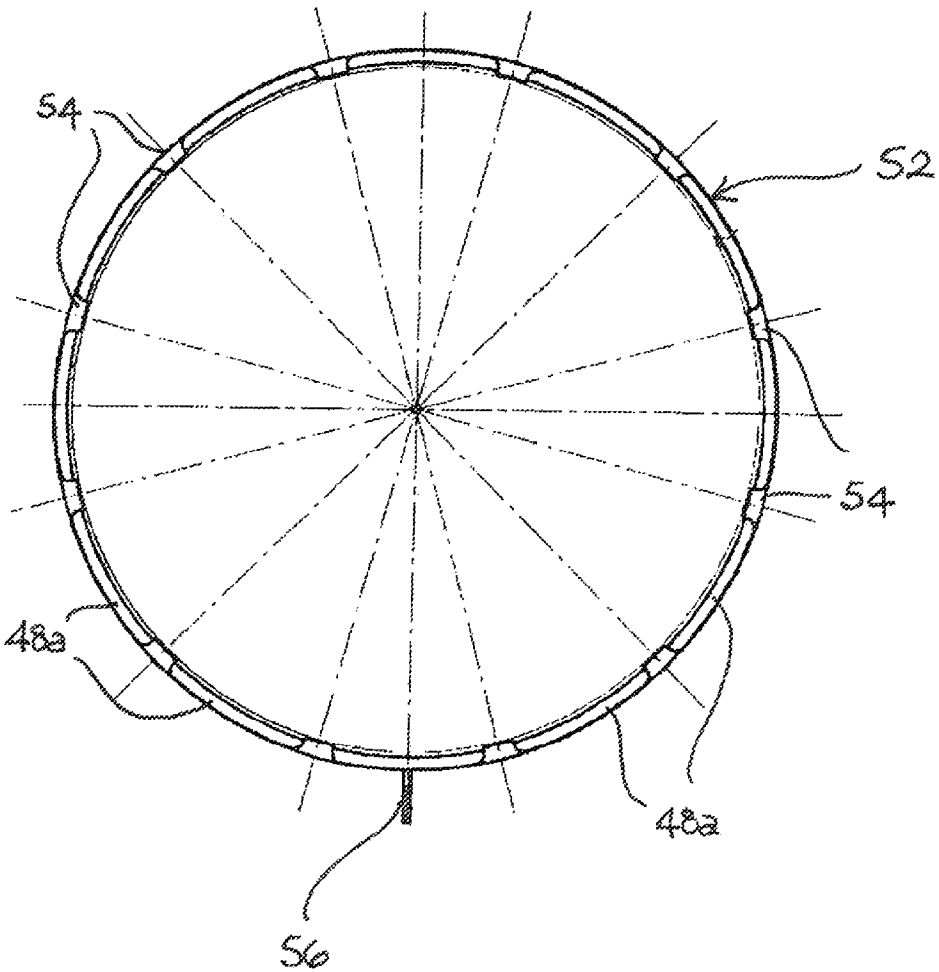
FIG. 3 is a diagrammatic view of a liner forming part of the axial flow steam turbine illustrated in FIGS. 1 and 2.

Due to the tangential motion of the steam within the circumferential collection channel 48, solid particles diverted into the circumferential collection channel 48 by the circumferential passage 46 can move circumferentially around the circumferential collection channel 48. In order to reduce the circumferential motion and thereby reduce the likelihood of the collected solid particles re-entering into the circumferential passage 46 and, thus, into the steam flowing through the first turbine stage 12, the circumferential collection channel 48 may include a plurality of circumferentially spaced flow arresters 54. In some exemplary embodiments, the flow arresters 54 can be formed integrally with the liner 52 or liner segments, as best seen in FIG. 3.

Each flow arrester 54 can extend axially across the entire width of the circumferential collection channel 48 and the flow arresters 54 thus divide the circumferential collection channel 48 into a plurality of individual part-circumferential collection compartments 48*a*.

In some exemplary embodiments, the circumferential collection channel 48 can be dimensioned so that there is sufficient space to accommodate solid particles accumulated over a period of time. That period of time could be the normal overhaul interval for the steam turbine 12 or some other suitable period of time, and upon expiration of a suitable period of time, the accumulated solid particles could be removed from the circumferential collection channel 48 and/or the liner 52 could be replaced. Replacement of the liner 52 would be necessary in situations where there has been erosion of the liner 52, and any integrally formed associated flow arresters 54, by the collected solid particles.

In other exemplary embodiments, one or more extraction pipes 56 can be provided to extract collected solid particles from the circumferential collection channel 48. It is believed that solid particles collected within the upper and possibly side circumferential regions of the circumferential collection channel 48 may have a tendency to move towards the lower circumferential region of the circumferential collection channel 48 under the action of gravity and possibly other forces. If the circumferential collection channel 48 is circumferentially continuous, for example, it is not divided into separate compartments 48*a*, it may therefore be sufficient to provide one or more extraction pipes 56 in only the lower circumferential region of the circumferential collection channel 48. However, each circumferential collection compartment 48*a* can be provided with a respective extraction pipe 56.

It is also envisaged that one or more inlet pipes could be provided, in addition to the one or more extraction pipes 56, to introduce fluid, such as air, into the circumferential collection channel 48. The introduction of fluid may dislodge accumulated solid particles and thereby enable those dislodged solid particles to be more readily extracted by the one or more extraction pipes 56.

In the illustrated exemplary embodiment, the radially outer static diaphragm ring 62*a* of the third turbine stage 60 can also include an annular axial extension 66 which extends in the axially upstream direction, towards the radially outer static diaphragm ring 22*a* of the second turbine stage 14. Like the annular axial extension 66, the illustrated annular axial extension 66 can include an extension ring which is secured to the radially outer static diaphragm ring 62*a* of the third turbine stage 60.

The annular axial extension 66 carries a circumferential tip sealing device 68 which cooperates with the shrouds 36 of the moving blades 30 of the second turbine stage 14 to minimise the leakage of steam between the tip portions 30*b* of the moving blades 30 and the annular axial extension 66. The tip sealing device 68 can be as described herein.

The annular axial extension 66 includes an axially upstream end which can be axially spaced from the radially outer static diaphragm ring 22*a* of the second turbine stage 14, and a circumferential passage 70 can thus be defined between the upstream end of the annular axial extension 66 and the radially outer static diaphragm ring 22*a*.

During operation of the steam turbine 10, solid particles contained within the steam flowing through the second turbine stage 14 can be directed into the circumferential passage 70, upstream of the circumferential row of moving blades 30 of the second turbine stage 14, by virtue of the tangential motion of the steam flow and those solid particles can then be diverted away from the steam flow by the circumferential passage 70. The circumferential passage 70 directs the solid particles into a circumferential collection channel 72 which, for example, includes the features described herein.

Erosion of the circumferential row of moving blades 30 of the second turbine stage 14 can thus be reduced due to the reduction of solid particles within the steam flowing through the circumferential row of moving blades 30 of the second turbine stage 14.

The radially outer static diaphragm rings of subsequent turbine stages can also be provided with particle extraction means as described herein.

Although exemplary embodiments of the disclosure have been described in the preceding paragraphs with reference to various examples, it should be understood that various modifications may be made to those examples without departing from the scope of the present disclosure.

For example, the annular axial extension 38, 66 can be an integral part of the radially outer static diaphragm ring 22*a*, 62*a* of the respective second or third turbine stage 14, 60, instead of being formed as a separate extension ring as aforesaid.

The circumferential tip sealing device 40 can include any suitable seal arrangement, such as sealing strips, fins, labyrinth seals, brush seals, or leaf seals, to prevent or at least minimise steam leakage past the tip portions 28*b* of the moving blades 28 of the first turbine stage 12.

The steam turbine 10 can be constructed as an impulse turbine, in which most of the turbine stage pressure drop takes places in the rows of static blades 24, 26, 64. However, the concepts described in this specification can be equally applicable to reaction turbines in which a substantial proportion of the pressure drop takes place over the rows of moving blades 28, 30.

Although the first, second and third turbine stages 12, 14, 60 are illustrated as being the first three expansion stages of the steam turbine 10 (i.e. stages '1', '2' and '3'), it should be understood that they could be later stages of the steam turbine 10. For example, the aforesaid first turbine stage 10 could be stage '2' with the second and third turbine stages 14, 60 being stages '3' and '4' respectively.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An axial flow steam turbine comprising:

a turbine casing containing a turbine stage, the turbine stage comprising:

a row of static blades;

a row of moving blades located downstream of the static blades in a turbine passage, the moving blades having radially outer shrouds that sealingly co-operate with an outer wall portion of the turbine passage; and a circumferentially and radially extending passage provided in the outer wall portion upstream of the row of moving blades to divert solid particles from steam flow during operation of the steam turbine, wherein the turbine casing between adjacent turbine stages includes a circumferential collection channel for collecting solid particles diverted through the circumferentially and radially extending passage, wherein the circumferential collection channel includes plural circumferentially spaced flow arresters arranged to minimise circumferential flow of solid particles within the circumferential collection channel, and wherein each of the circumferentially spaced flow arresters extends axially across the circumferential collection channel to divide the circumferential collection channel into plural circumferential compartments.

2. An axial flow steam turbine according to claim 1, wherein the circumferential passage communicates in a substantially radial direction with an inlet region of the circumferential collection channel.

3. An axial flow steam turbine according to claim 2, wherein the circumferential passage has an inclined surface operative to direct solid particles from the circumferential passage into the circumferential collection channel.

4. An axial flow steam turbine according to claim 1, wherein the circumferential passage is substantially aligned with leading edges of the moving blades.

5. An axial flow steam turbine according to claim 1, wherein the circumferential collection channel comprises:

a liner to minimise erosion of the turbine casing by solid particles diverted through the circumferential passage into the circumferential collection channel.

6. An axial flow steam turbine according to claim 1, comprising:

a particle extraction arrangement for communication with the circumferential collection channel to extract collected solid particles therefrom.

7. An axial flow steam turbine according to claim 6, wherein at least one inlet of the particle extraction arrangement communicates with a lower circumferential region of the circumferential collection channel.

8. An axial flow steam turbine according to claim 5, wherein the flow arresters are formed integrally with the liner.

9. An axial flow steam turbine according to claim 6, wherein at least one inlet of the circumferential compartments communicates with the circumferential collection channel between each pair of adjacent circumferentially spaced flow arrestors.

10. An axial flow steam turbine according to claim 1, comprising:

a fluid inlet arranged to inject fluid into the circumferential collection channel for dislodging accumulated solid particles from the circumferential collection channel.

11. An axial flow steam turbine according to claim 2, wherein the circumferential passage is substantially aligned with leading edges of the moving blades.

* * * * *